US008150080B2

(12) United States Patent
Rohrseitz

(10) Patent No.: US 8,150,080 B2
(45) Date of Patent: Apr. 3, 2012

(54) METHOD FOR ADAPTING A HEARING AID USING A GENETIC FEATURE

(75) Inventor: Kristin Rohrseitz, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1244 days.

(21) Appl. No.: 11/899,552

(22) Filed: Sep. 6, 2007

(65) Prior Publication Data

US 2008/0063227 A1 Mar. 13, 2008

(30) Foreign Application Priority Data

Sep. 7, 2006 (DE) ..... 10 2006 042 040

(51) Int. Cl.
*H04R 25/00* (2006.01)

(52) U.S. Cl. ..... 381/314; 381/1; 381/60; 381/312; 381/323; 600/25; 607/55; 607/57

(58) Field of Classification Search ..... 381/23.1, 381/312, 60, 68, 320, 321; 600/25; 607/55, 607/57

See application file for complete search history.

(56) References Cited

U.S. PATENT DOCUMENTS 6,035,050 A * 3/2000 Weinfurtner et al. ..... 381/313
2005/0254675 A1* 11/2005 Sacha ..... 381/312

OTHER PUBLICATIONS

Maria Bitner-Glindzicz, Hereditary Deafness and Phenotyping in Humans, 2002, British Medical Bulletin, Edition 63, p. 73-94.*

Stephen A. Wilcox, Kerryn Saunders, Amelia H. Osborn, Angela Arnold, Julia Wunderlich, Therese Kelly, Veroican Collins, Leah J. Wilcox R. J. Mckinlay Gardner, Maria Kamarinos, Barbara Cone-Wesson, Robert Williamson, Han-Henrik M. Dahl, High Frequency Hearing Loss Correlated With Mutations in the GJB2 gene, Springer-Verlag, Mar. 2000, p. 399-405.*

Susan Boswell, Pediatric Audiology Conference Bridges Genetics and Clinical Practice (Mar. 20, 2004), The Asha Leader, <http://www.asha.org/Publications/leader/2004/040330/040330a.htm>.*

Smeeth et al: "Reduced hearing, ownership, and use of hearing aids in elderly people in the UK- the MRC Trial of the Assessment and Management of Older People in the Community: a cross- sectional survey", Apr. 2002, vol. 359, pp. 1466-1470, The Lancet Publishing Group.

Ceccarani et al., Gendeaf News, "Mitteilungsblatl des Europäischen Netzwerks für genetisch bedingte Taubheit", 2005, pp. 1-16, No. 6, Bulletin.

Marlene Bagatto, "Clinical Protocols for Hearing Instrument Fitting in the Desired Sensation Level Method", Trends in Amplification, vol. 9, No. 4, 2005, pp. 199-226, Abstract.

Iris Schrijver, "Hereditary Non-Syndromic Sensorineural Hearing Loss", Journal of Molecular Diagnostics, vol. 6, No. 4, Nov. 2004, pp. 275-284.

* cited by examiner

*Primary Examiner* — Steven Loke
*Assistant Examiner* — Cuong Nguyen

(57) ABSTRACT

The present invention relates to a method for adapting a hearing aid with at least one input converter, a signal processing device and an output converter by using a genetic feature of the wearer to whom the hearing aid is to be adapted. Depending on the genetic feature, at least one adaptable parameter is adapted by the signal processing device. The invention further relates to a hearing device system which can be adapted to the hearing device wearer as a function of a genetic feature.

13 Claims, 1 Drawing Sheet

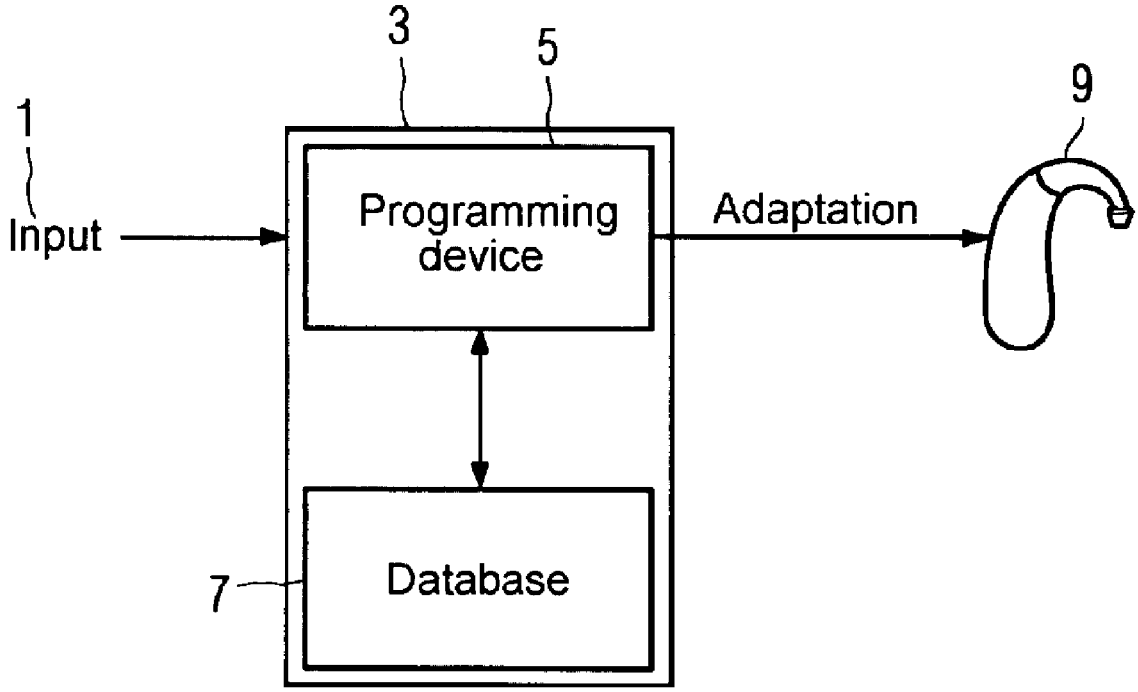
3
5
9
1
Input
Programming device
Adaptation
Database
7

METHOD FOR ADAPTING A HEARING AID USING A GENETIC FEATURE

CROSS REFERENCE TO RELATED APPLICATIONS

This application claims priority of German application No. 10 2006 042 040.3 filed Sep. 7, 2006, which is incorporated by reference herein in its entirety.

FIELD OF THE INVENTION

The present invention relates to a method for adapting a hearing aid with at least one input converter, a signal processing device and an output converter by using a genetic feature of the wearer to whom the hearing aid is to be adapted. The invention further relates to a hearing aid system which can be adapted to the hearing aid wearer depending on a genetic feature.

BACKGROUND OF THE INVENTION

To enable hearing aids to offer the optimum benefits to their wearers they must compensate for the hearing problem. A hearing aid primarily compensates for a hearing impairment by amplifying the incoming signals sufficiently. Modern hearing aids can be adapted to a wearer's individual needs. In practice such adaptation presents difficulties, so that the hearing aid wearer is not always catered for in the best possible manner.

With modern hearing aids a plurality of adaptable parameters can be adapted to the wearer, e.g. the sound pressure level as a function of the frequency, type and degree of noise reduction, the control time, and much more besides. Previously adaptation has involved measuring the different hearing thresholds (depending on the frequency) of the wearer. Based on these measurements, specific adaptation formulas can be used for suitable adaptation and the necessary amplification for the hearing aid can be determined. Examples of such adaptation formulas are the DSL (Desired Sensation Level) method described in Bagatto et al., (2005), Clinical protocols for hearing instrument fitting in the DSL method, trends amplification, 9(4):199-226, or the NAL-NL1 method (National Acoustics laboratories "non-linear fitting Version 1"). One problem with these adaptation methods lies in the fact that they require measurements to be taken on or in the ear of the wearer and the latter's cooperation is required. The methods are frequently lengthy and, with small children especially, are difficult or even impossible to perform.

It is known that many hearing problems have genetic causes, see also Schrijver, Hereditary non-syndromic sensorineural hearing loss, transforming silence to sound, (2004), Journal of Molecular Diagnostics, 6(4), 275-284. Hearing problems with genetic origins are widespread. Appr. 1 in 1000 children is born deaf and 1 in 300 children has a congenital loss of hearing, a further 1 in 1000 children suffers a significant loss of hearing before reaching adulthood. There is a genetic cause in around 50% of these cases. Hearing problems with genetic origins occur for different reasons, it is estimated that around 1% of all human genes play a part in the hearing process. In 70% of all cases a hearing loss with genetic origins is non-syndromic, i.e. hearing loss with genetic origins is not connected with an easy-to-diagnose syndrome, such as Usher Syndrome and similar syndromes for example. Hearing loss with genetic origins can be inherited in an autosomal recessive (AR), autosomal dominant (AD), x-chromosomal (X) or mitochondrial (mito) manner.

SUMMARY OF THE INVENTION

The object of the present invention is to provide a method and a hearing device system which takes account of the genetic causes of a hearing impairment and uses said causes to adapt the hearing device system to the wearer.

The object of the invention is achieved by the claims.

The mutations of genes which have a role to play in the hearing process lead to specific hearing problems associated with the respective mutation. The mutations can lead to an increase in the threshold of hearing but also to distortions in perception.

The basis of the invention is that knowledge of the genetic cause of the hearing problem makes it possible to adapt the hearing aid system in the optimum manner. Thus it can be of advantage with a specific cause of a hearing problem, to have a highest possible amplification with fast control times, whereas another hearing loss can be compensated for far more effectively by lower amplification in conjunction with longer control times and a greater noise reduction. Specific mutations also give rise to a hearing loss in specific frequency ranges, so that the hearing aid can adapted so as to explicitly amplify in these hearing ranges.

Inventively a method for adapting a hearing aid with at least one electroacoustic input converter, a signal processing device and an electroacoustic output converter is provided which has the following the steps:

a) Detecting at least one genetic feature of a hearing aid wearer and transmitting the genetic feature to a device for adapting of the hearing aid;

b) Adapting at least one adaptable parameter depending on the genetic feature.

Preferably the adaptation of the adaptable parameter is undertaken depending on the genetic feature by assignment of an instruction for adapting the adaptable parameter of the hearing aid to the genetic feature by the device for adapting the hearing aid and adaptation of the adaptable parameter by the signal processing device of the hearing aid for individual adaptation of the hearing aid to the hearing aid wearer.

Within the context of this invention "genetic feature" means a defined genetic feature which can be defined by a gene technology or molecular diagnostic method. These types of molecular diagnostic method include methods known to the person skilled in the art, for example karyotyping (coloring the chromosomes in the karyogram), sequencing, RFLP analysis (restriction fragment-length polymorphism analysis), PCR analysis, as well any other method which is suitable to establish a defined genetic defect. Familial analysis is also considered if it known that there is a defined genetic defect in the family.

A "device for adapting the hearing aid" means a device with which a hearing aid or a hearing aid system can be adapted, for example a computer-aided programming device, the device can however also be incorporated into the signal processing device of the hearing aid itself. In this case the method steps execute in the hearing aid itself after the genetic feature is entered.

The "entry of a genetic feature into the device for adapting of the hearing aid" means entering or transmitting the information about the genetic feature involved for the individual hearing aid wearer or patient into the device for adapting the hearing aid. This can be done manually via a corresponding interface (e.g. via a keyboard for a computer-aided programming device) or also by data transmission from a data memory, in which the information about the genetic feature of the patient is stored. This can be a database or also an appropriate smart card of the patient for example which contains the latter's electronic patient notes.

The term "an instruction for adapting" means an instruction, a computer instruction, an algorithm, a factor or information in the widest sense which can be used by the signal processing device of the hearing aid to adapt the amplification characteristics of the hearing aid to the requirements of the wearer.

An "adaptable parameter" can especially be an amplification, an amplification factor, a frequency-specific amplification, a frequency curve, a sound pressure level, a frequency-specific sound pressure level, a control time (e.g. a synchronization or decay time), a noise reduction or in the widest sense a parameter, with the aid of which the acoustic characteristics of the hearing aid can be adapted to the needs of the hearing aid wearer.

The genetic feature can be a defined nucleic acid sequence, especially a mutation, a deletion, an insertion, duplication, or a single-point mutation of a gene, of a gene segment or of a chromosome segment. In particular the genetic feature can be a mutation which is phenotypically associated with a hearing problem or hearing loss.

A series of gene defects have now become known which are associated with hearing impairment. In some cases already-established diagnostic methods exist for these gene defects and in some cases it is also known how the genetic feature or the genetic defect specifically affects the hearing problem.

Table 1 gives an overview of known genetic features which are associated with hearing problems and for which clinical laboratory tests are available (with acknowledgements to Schrijver, Journal of Molecular Diagnostics (2004), 6(4), 275-284).

TABLE 1

| Chromosomal location[1] | Locus/Mutation[2] | Gene Name[3] | Inheritance[4] | Protein[5] | Function[6] |
|---|---|---|---|---|---|
| 13q11-12 | DFNB1/A3 | GJB2 | AR/AD | Connexine 26 | Gap junction |
| 13q12 | | GJB6 | AR/AD | Connexine 30 | Gap junction |
| 7q31 | DFNB4 | SLC26A4 | AR | Pendrine | Anion transporter |
| 14q12-13 | DFNA9 | COCH | AD | Cochlin | extracellular matrix protein |
| Mitoch. | 1555A > G<br>7445A > G<br>7472insC<br>7511T > C other | MTRNR1<br>MTTS1 | mito. | | 12SrRNA<br>tRNA Serin |
| Xq21.1 | DFN3 | POU3F4 | X | POU domains class 3 | Transcription factor |
| 4p16.1 | DFNA6/14/38 | WFS1 | AD | Wolframin | Unclear: ER Transmembrane protein |

[1]designates chromosome and locus, "Mitoch." designates mitochondrial DNA;
[2]exact designation of the locus or of the mutation;
[3]Designation of the gene;
[4]Type of Inheritance, autosomal recessive (AR), autosomal dominant (AD), x-chromosomal (X) or mitochondrial (mito);
[5]Designation of the encoded protein, if known;
[6]Designation of the function of the encoded protein, if known. A number of mutations which lead to a loss of function of the protein are described in each case for genes GJB2 and GJB6.

It is known in particular that mutations in the genes GJB2 and GJB6 which encode Connexine lead to hearing problems. Connexines are proteins which are necessary in the formation of the so-called GAP junctions via which ion canals can be opened between adjacent cells. One of their important roles lies in the transmission of signals.

Mutations in the COCH gene typically lead to an autosomal dominant inherited non-syndromic post-lingual loss or hearing which begins in adulthood and is progressive. In this case a loss of hearing occurs especially at high frequencies. When the inventive adaptation method is used it is possible in this case to specifically correct this hearing loss by an appropriate adaptation.

Numerous further gene defects which are connected with hearing problems of hearing loss are known in medical literature. The result of this has been, when hearing difficulties are discovered in new-born babies or children, to advise genetic testing in order to enable a genetic cause to be established for hearing problems. This will lead to genetic data being available for a significant proportion of patients with hearing problems which can be used inventively for adapting the hearing aid system. As knowledge about the genes decoded in the human genome and about their function increases, it is to be expected that further genes or their mutations will be able to be associated with specific hearing problems.

Preferably the instruction for adapting the adaptable parameters of the hearing aid to the genetic feature will be adapted by calling up comparison values which are stored in a database.

In accordance with a further aspect of the present invention the preference is for a digital signal processing device to be used in the method. The adaptation can preferably be performed by employing appropriate software.

In accordance with a further preferred aspect of invention, data, e.g. information about genetic features or instructions for adapting parameters, is transmitted wirelessly to the signal processing device of the hearing aid. This especially advantageously enables the hearing aid to be adapted without the hearing aid wearer having to remove the hearing aid from their ear. This is especially advantageous in adapting hearing aids for small children.

The arrangement for executing the inventive method includes a hearing aid with at least one electroacoustic input converter, a signal processing device and an electroacoustic output converter and a device for adapting the hearing aid with an input option for entering information relating to a genetic feature of a hearing aid wearer.

BRIEF DESCRIPTION OF THE DRAWINGS

Further characteristics and advantages of the present invention are explained in greater detail with reference to the following exemplary embodiment and the appended FIGURE, which shows a schematic diagram of the adaptation of a hearing aid in accordance with an embodiment of the present invention.

DETAILED DESCRIPTION OF THE INVENTION

A genetic feature 1 detected from the hearing aid is entered into the device 3 for adapting the hearing aid 9. This can for example be entered manually by the hearing aid acoustic specialist but it is also conceivable for the information which relates to the genetic feature to be transmitted directly into the device 3 for adapting the hearing aid 9. The device for adapting of the hearing aid has a programming device 5 and a database 7. The information entered is compared with the contents of the database is order to establish whether information about the genetic defect present is available. Data about known and defined genetic defects is stored in the database 7 and linked to the corresponding adaptable parameters via which the adapting of the signal processing device of the hearing aid 9 can be undertaken. In the programming device the information entered is compared with the information present in the database, and if a genetic feature is present the corresponding adaptable parameter is selected and an instruction for adapting the parameter is output to the signal processing device of the hearing aid.

There is likewise inventive provision for the device for adapting of the hearing aid to be integrated into the hearing aid itself, e.g. as part of the signal processing device. In this case the Information about the genetic feature must be transmitted directly to the hearing aid, for example by wireless transmission, the process of adapting the hearing aid in response to the input of the genetic feature is then undertaken in the hearing aid itself.

The invention claimed is:

1. A method for adapting a hearing aid based on a genetic feature of a wearer of the hearing aid, comprising:

detecting the genetic feature of the wearer of the hearing aid, wherein the genetic feature is a mutation of a gene which is phenotypically associated with a hearing problem or hearing loss of the wearer;

transmitting the genetic feature to the hearing aid, wherein the genetic feature is transmitted to a device of the hearing aid and compared with a plurality of known and defined genetic defects that are stored in a database; and adapting an adaptable parameter of the hearing aid based on the genetic feature so that the hearing aid is individually adapted to the wearer.

2. The method as claimed in claim 1, wherein the device selects the adaptable parameter based on the comparison and sends out an instruction for adapting the adaptable parameter to a signal processing device of the hearing aid.

3. The method as claimed in claim 1, wherein the genetic feature is transmitted to a signal processing device of the hearing aid and compared with a plurality of known and defined genetic defects that are stored in a database.

4. The method as claimed in claim 3, wherein the signal processing device selects the adaptable parameter based on the comparison and adapts the adaptable parameter accordingly.

5. The method as claimed in claim 1, wherein the adaptable parameter is selected from the group consisting of: an amplification, an amplification factor, a frequency-specific amplification, a frequency curve, a sound pressure level, a frequency-specific sound pressure level, a control time, and a noise reduction.

6. A hearing aid, comprising:

an electroacoustic input converter that converts an acoustic input signal to an electrical signal;

a device that receives a genetic feature of a wearer of the hearing aid;

a storage device that stores a database of a plurality of known and defined genetic defects, wherein the genetic feature is a mutation of a gene which is phenotypically associated with a hearing problem or hearing loss of the wearer;

a signal processing device that adapts an adaptable parameter of the hearing aid by an instruction sent out from the device based on the genetic feature and processes the electrical signal based on the adaptable parameter; and an electroacoustic output converter that converts the processed electrical signal to an acoustic output signal.

7. The hearing aid as claimed in claim 6, wherein the device: compares the genetic feature with the known and defined genetic defects, selects the adaptable parameter based on the comparison, and sends the instruction out to the signal processing device accordingly.

8. The hearing aid as claimed in claim 6, wherein the adaptable parameter is selected from the group consisting of: an amplification, an amplification factor, a frequency-specific amplification, a frequency curve, a sound pressure level, a frequency-specific sound pressure level, a control time, and a noise reduction.

9. The hearing aid as claimed in claim 6, wherein the signal processing device is a digital signal processing device.

10. A hearing aid, comprising:

an electroacoustic input converter that converts an acoustic input signal to an electrical signal;

a signal processing device that: receives a genetic feature of a wearer of the hearing aid, adapts an adaptable parameter of the hearing aid based on the genetic feature, and processes the electrical signal based on the adaptable parameter;

an electroacoustic output converter that converts the processed electrical signal to an acoustic output signal; and a storage device that stores a database of a plurality of known and defined genetic defects, wherein the genetic feature is a mutation of a gene which is phenotypically associated with a hearing problem or hearing loss of the wearer.

11. The hearing aid as claimed in claim 10, wherein the signal processing device: compares the genetic feature with the known and defined genetic defects, selects the adaptable parameter based on the comparison, and adapts the adaptable parameter accordingly.

12. The hearing aid as claimed in claim 10, wherein the adaptable parameter is selected from the group consisting of: an amplification, an amplification factor, a frequency-specific amplification, a frequency curve, a sound pressure level, a frequency-specific sound pressure level, a control time, and a noise reduction.

13. The hearing aid as claimed in claim 10, wherein the signal processing device is a digital signal processing device.

* * * * *